US005817454A

United States Patent [19]

Harris et al.

[11] Patent Number: 5,817,454

[45] Date of Patent: Oct. 6, 1998

[54] PORTABLE APPARATUS AND METHOD FOR DETECTION OF METHYLXANTHINE CHEMICAL SPECIES

[75] Inventors: Stuart Harris; David Levin, both of Bal Harbour, Fla.

[73] Assignee: Coffee Chek, Inc., Bal Harbour, Fla.

[21] Appl. No.: 477,440

[22] Filed: Jun. 7, 1995

[51] Int. Cl.[6] ..... C12Q 1/00

[52] U.S. Cl. ..... 435/4; 435/19; 435/21; 435/174; 435/182; 436/164; 436/103; 436/105; 422/55; 422/56; 422/57

[58] Field of Search ..... 422/55, 56, 57; 435/4, 19, 21, 174, 182; 436/164, 810, 103, 104, 105, 904; 514/263, 46

[56] References Cited

U.S. PATENT DOCUMENTS

| | | | |
|---|---|---|---|
| 3,616,251 | 10/1971 | Linoli | 435/805 X |
| 3,910,907 | 10/1975 | O'Brien et al. | 260/248 |
| 4,149,852 | 4/1979 | Tiru et al. | 23/230 R |
| 4,185,108 | 1/1980 | Samour et al. | 424/274 |
| 4,328,231 | 5/1982 | Zajernee Balazs et al. | 424/256 |
| 4,587,100 | 5/1986 | Amano et al. | 422/56 |
| 4,782,016 | 11/1988 | Norton | 435/21 |
| 4,782,017 | 11/1988 | Frickey et al. | 435/21 |
| 4,806,470 | 2/1989 | Frickey et al. | 435/21 |
| 4,855,226 | 8/1989 | Polito et al. | 435/7.1 |
| 4,883,801 | 11/1989 | Nathanson | 514/263 |
| 4,898,813 | 2/1990 | Albarella et al. | 435/4 |
| 5,188,941 | 2/1993 | de Castio et al. | 435/19 |
| 5,610,072 | 3/1997 | Scherl et al. | 436/96 |

OTHER PUBLICATIONS

Chemical Abstracts, vol. 88, No. 5, abstract No. 34168 (Jan. 30, 1978).

Chemical Abstracts, vol. 76, No. 15, abstract No. 80990 (Apr. 10, 1972).

Zuk et al., "Enzyme Immunochromatography —A Quantitative Immunoassay Requiring No Instrumentation," in *Clinical Chemistry,* vol. 31, No. 7, pp. 1144–1150 (Jul. 1985).

Tyhach et al., "Adaptation of Prosthetic–Group–Label Homogeneous Immunoassay to Reagent Strip Format," in *Clinical Chemistry,* vol. 27, No. 9, pp. 1499–1504 (Sep. 1981).

Wada et al., "Analysis of the Kinetics of Cyclic AMP Hydrolysis by the Cyclic GMP–Stimulated Cyclic Nucleotide Phosphodiesterase," in *Journal of Biological Chemistry,* vol. 262, No. 29, pp. 13938–13945 (Oct. 15, 1987).

Sugiyama et al., "An Enzymatic Fluorometric Assay for Adenosine 3',5'–Monophosphate," in *Analytical Biochemistry,* vol. 218, No. 1, pp. 20–25 (Apr. 1994).

Pieroni et al., "Distinct Characteristics of the Basal Activities of Adenyl Cyclases 2 and 6," in *J. Biol. Chem.,* vol. 270, No. 36, pp. 21368–21373 (Sep. 8, 1995).

Embase Abstract No. 87196334 (admitted Prior Art).

Embase Abstract No. 86163240 (admitted Prior Art).

Analytical Abstracts Online Accession No. 51–06–D–00050.

*Basic Clinical Pharmacology,* pp. 225–226 (3d ed.). Appleton & Lange published 1987.

Stryer & Lubert, *Biochemistry,* p. 810, p. 544 (1975).

Means et al., "Calmodulin" in *Cellular Calcium,* Chapter 9 (J.G. McCormack and D.H. Cobbold eds. 1991). pp. 205–213, 222–227, 242–245.

*Clinical Chemistry,* p. (4th ed.) (Kaplan et al. eds.). pp. 419, 420 1995. Williams & Wilkins published.

Drioli et al., "The Kinetic Behavior of Enzymes Gelified on Ultrafiltration Membranes," Analysis and Control of Immobilized Enzyme Systems (North–Holland Publishing Company —Amsterdam) pp. 179–186, 1975.

Enzyme Handbook (Springer–Verlag Berlin Heidelberg 1991) vol. 4 alkaline phosphatase 3.1.3.1 pp. 1–10 and Phosphodiestrase I 3.1.4.1. pp. 1–6.

O. Zaborsky, CRC Immobilized Enzymes (CRC Press Cleveland, Ohio 1973) pp. 1–3.

*Primary Examiner*—Carol A. Spiegel
*Attorney, Agent, or Firm*—Baker & Botts, L.L.P.

[57] ABSTRACT

A portable apparatus for detecting the presence of at least one methylxanthine chemical species such as caffeine or theophylline in a beverage comprises a first portion comprising an effective concentration of phosphodiesterase enzyme, a second portion comprising cyclic AMP, and means for indicating inhibition of degradation of the cyclic AMP by the phosphodiesterase due to the presence of the methylxanthine species. A method for determining the presence of at least one methylxanthine chemical species in a beverage comprises contacting at least one test portion of the beverage with effective concentrations of at least one phosphodiesterase enzyme and cyclic AMP, and further contacting the test portion with means for indicating the inhibition of the degradation of the cyclic AMP by the phosphodiesterase due to the presence of the methylxanthine species. The apparatus and method are advantageous in that they provide a simple and effective means of determining whether methylxanthine chemical species such as caffeine or theophylline are present in coffee, tea and other beverages.

25 Claims, 2 Drawing Sheets

PORTABLE APPARATUS AND METHOD FOR DETECTION OF METHYLXANTHINE CHEMICAL SPECIES

SPECIFICATION

BACKGROUND OF THE INVENTION

This invention relates to a portable apparatus for detecting the presence of methylxanthine chemical species in solution, and a method of using such an apparatus. More particularly, this invention relates to a portable apparatus for detecting the presence of methylxanthine chemical species such as caffeine or theophylline in solutions such as beverages, and a method of using such an apparatus.

It is well known that certain chemical species contained in beverages and the like may have adverse health effects on certain individuals. For example, pregnant women and persons having ulcers or other gastrointestinal disorders are routinely advised to avoid caffeine in foods and beverages. In addition, many individuals have an adverse reaction to theophylline, which is typically contained in tea and cocoa-containing beverages. Moreover, it is well known that caffeine and theophylline may act as stimulants and may interfere with the normal sleeping process. Accordingly, many individuals deliberately order decaffeinated beverages from restaurants and the like, especially in the evening or at night. However, in busy eating or drinking establishments, a caffeinated beverage may occasionally mistakenly be served despite the placing of an order for a decaffeinated beverage. The presence of, for example, caffeine in a beverage is usually initially undetectable by an individual. If the individual is mistakenly served a caffeinated beverage, that person may experience sleeplessness or anxiety. Also, of course, such inadvertent ingestion of caffeine is undesirable for pregnant women, persons having gastrointestinal disorders, and others who have been medically advised to avoid the ingestion of caffeine.

Various methods of determining the presence of methylxanthine compounds are known to those skilled in the art. For example, a method of measuring theophylline concentrations in whole blood using an immunochromatographic stick is described in Elias-Jones, A. C. et al., Arch. Dis. Child. 62/8 (1987), pp. 836–54. In addition, a rapid method for detecting the presence of caffeine using thin layer chromatography (TLC) is disclosed in DIALOG computer database file 305 no. 093378. However, such techniques are either inconvenient or difficult to employ in other than a laboratory environment.

In view of the foregoing, it would be useful to be able to employ a simple method and apparatus to detect the presence of methylxanthine chemical species such as caffeine or theophylline. It would be particularly useful to be able to employ a portable apparatus for such detection, as this would enable the user to readily determine, for example, whether beverages served at restaurants and the like are in fact decaffeinated.

It is one object of this invention to provide a simple portable apparatus for the detection of methylxanthine chemical species such as caffeine or theophylline in solution. It is one feature of the apparatus that it is easy to use. It is another feature of the apparatus that it is portable and may readily be used in restaurants and similar establishments. It is another feature of the apparatus that, in one embodiment, either or both of theophylline or caffeine may be detected. The apparatus of this invention advantageously enables the user to be able to determine whether, for example, a beverage being served has caffeine or theophylline contained therein.

It is another object of this invention to provide a simple method for the detection of methylxanthine chemical species such as caffeine or theophylline in solution. It is one feature of the method that it is easy to use. It is another feature of the method that it is employed in conjunction with a portable apparatus for the detection of such chemical species, and may readily be used in restaurants and similar establishments. It is yet another feature of this method that, in one embodiment, either or both of theophylline or caffeine may be detected. The method of this invention advantageously enables the user to be able to determine whether, for example, a beverage being served has caffeine or theophylline contained therein.

SUMMARY OF THE INVENTION

This invention is directed to a portable apparatus for detecting the presence of methylxanthine chemical species in solution, and a method for determining the presence of such species in solution. Examples of the methylxanthine chemical species which may be detected using the method and apparatus of this invention are caffeine and theophylline. The apparatus comprises a first portion comprising at least one phosphodiesterase enzyme, a second portion comprising cyclic AMP, and means for indicating the inhibition of the degradation of cyclic AMP by phosphodiesterase activity due to the presence of at least one methylxanthine compound.

For example, means responsive to a change in concentration of hydrogen ions in solution due to the degradation of cyclic AMP by phosphodiesterase activity may be used to indicate the inhibition of such degradation due to the presence of at least one methylxanthine compound such as theophylline or caffeine. More particularly, a calorimetric pH indicator may be used to determine the change in hydrogen ion concentration.

The method of this invention comprises contacting at least one test portion of the solution to be tested with effective concentrations of at least one phosphodiesterase enzyme and cyclic AMP, and thereafter contacting the test portion with means for indicating the inhibition of the degradation of cyclic AMP by phosphodiesterase due to the presence of at least one methylxanthine compound.

The method and apparatus of this invention are advantageous in that they provide a simple and effective means of determining whether methylxanthine chemical species such as caffeine or theophylline are present in solutions such as coffee, tea and other beverages.

DETAILED DESCRIPTION OF THE INVENTION

Figure 1:
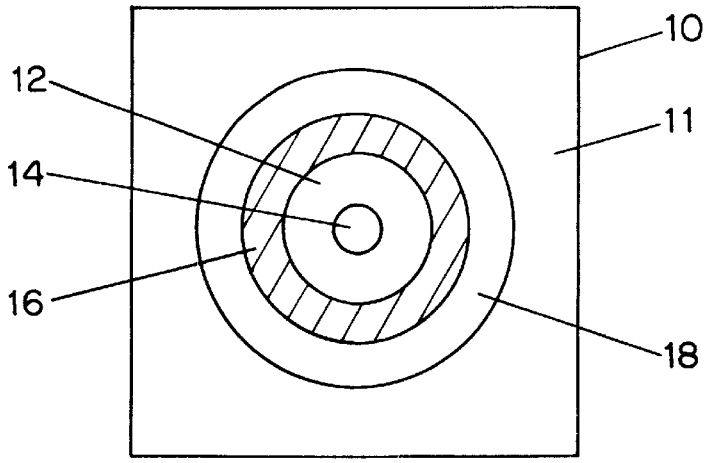
FIG. 1 shows a top exposed view of one embodiment of the apparatus of this invention, termed a "radial" configuration.

The apparatus of this invention employs means for detecting the presence of at least one methylxanthine chemical species which reflects the known biologic or pharmacologic activity of such compounds. As used in the specification and claims, the term "methylxanthine chemical species" refers to at least one of caffeine, theophylline, and related phosphodiesterase inhibitors. In a preferred embodiment, the chemical species is caffeine. In another preferred embodiment, the chemical species is theophylline. In yet another preferred embodiment, the apparatus is capable of detecting either or both theophylline and caffeine.

As disclosed, for example, in Stryer & Lubert, *Biochemistry* pp. 810 (1975), it is well known that cyclic adenosine-3',5'-monophosphate (commonly referred to as cyclic AMP) is degraded by the enzyme phosphodiesterase to yield AMP as set forth below:

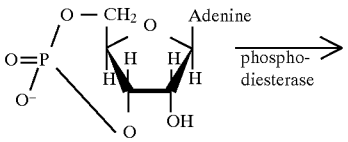

Cyclic AMP

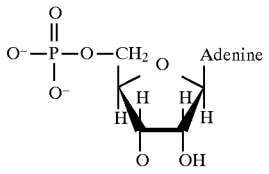

AMP

However, the above reaction is inhibited by the presence of theophylline, caffeine and other related methylxanthine compounds, as disclosed, for example in *Basic Clinical Pharmacology*, p. 225 (3d ed.). Accordingly, the presence of methylxanthine species such as caffeine or theophylline in biologically active concentrations in a beverage sample being tested inhibits the phosphodiesterase enzyme reaction with cyclic AMP, thereby causing a measurable (by calorimetric or other means) difference in one or more of the various variables (e.g. pH, cyclic AMP concentration, AMP concentration) associated with the phosphodiesterase-catalyzed cyclic AMP degradation reaction as compared to a reference solution not containing such methylxanthine compounds.

In the present invention, any variable or measurable change resultant from the phosphodiesterase-catalyzed cyclic AMP degradation reaction may be employed as an "output signal" which is transferred as an "input signal" to means for indicating the inhibition of the degradation of cyclic AMP by phosphodiesterase due to the presence of at least one methylxanthine compound. Examples of such variables are as follows: hydrogen ion concentration or pH, adenosine/monophosphate (AMP) concentration, and cyclic AMP concentration. Furthermore, these variables may provide the "input" for secondary reactions such as the venom-catalyzed dephosphorylation of AMP (i.e. the degradation of AMP in the presence of venom to adenosine and phosphate, as is further discussed below).

More particularly, the apparatus comprises in a first portion an effective concentration of cyclic AMP and in a second portion an effective concentration of phosphodiesterase, wherein the phosphodiesterase and cyclic AMP may be contacted in the presence of a test portion of the solution of interest (e.g. a beverage) to achieve the desired reaction, which in turn causes degradation of cyclic AMP and the attendant measurable change in one or more of such variables. The apparatus additionally comprises means for indicating the inhibition of the degradation of cyclic AMP by phosphodiesterase due to the presence of at least one methylxanthine compound.

The degradation of cyclic AMP to AMP by phosphodiesterase enzyme typically takes place in aqueous medium, and causes the hydrolyzation of cyclic AMP and generation of H+ ions as follows:

$$\text{Cyclic AMP} + H_2O \rightarrow \text{AMP} + H+$$

Thus, the reaction ordinarily causes a decrease in the pH of the medium in which the reaction takes place. In one particularly preferred embodiment of this invention, the difference between the pH decrease due to the reaction in the absence of methylxanthine compounds and the attendant reduced pH decrease in the presence of such compounds advantageously enables the user of the apparatus to determine whether such compounds (e.g. theophylline or caffeine) are present in the test sample.

In a particularly preferred embodiment, the means for indicating the inhibition of phosphodiesterase activity due to the presence of at least one methylxanthine compound is means responsive to a change in concentration of hydrogen ions in solution due to the cyclic AMP-phosphodiesterase reaction. In a particularly preferred embodiment, the responsive means is a calorimetric pH indicator contained in the apparatus which enables the user to monitor the pH shift. By way of example, a calorimetric pH indicator which may be employed in the apparatus is nitrazine test paper (available, for example, from Bristol Myers-Squibb Co.).

In this embodiment, the apparatus may be calibrated to yield a specific colorimetric pH indicator color change upon the use of the apparatus with a test solution which does not contain methylxanthine compounds such as theophylline or caffeine. Typically, it is expected that such a test solution will experience a pH shift from about 7–8 initially to about 5–6 as the solution H+ ion concentration increases due to the contacting and reaction of cyclic AMP and phosphodiesterase. Accordingly, the proportional colorimetric indicator change may be monitored to provide a "base line" calorimetric value. The presence of caffeine, theophylline or other methylxanthine compounds in the solution to be tested (e.g. a beverage which may contain such compounds) will cause a lesser pH change if the test solution contains such compounds, as the compounds will inhibit the release of H+ ions from the phosphodiesterase-catalyzed cyclic AMP degradation reaction. Accordingly, a variation in the colorimetric indicator response will occur.

In one particularly preferred embodiment, the presence or absence of caffeine or theophylline is determined by the calorimetric response of the apparatus to the test solution or beverage. In another preferred embodiment, the presence or absence of caffeine or theophylline is determined by the calorimetric response of the apparatus to the test solution or beverage together with the time variation of the calorimetric change: i.e. by monitoring as a function of time the calorimetric variation. A colorimetric calibration curve may be provided separately with the apparatus, or may be integral to the apparatus to achieve the desired results. Similarly, a time calibration curve may be provided separately with the apparatus, or may be integral to the apparatus. In order to properly maintain the pH of the solutions within the appropriate range, salts and other buffers may be employed in conjunction with the apparatus in a manner well known to those skilled in the art.

In a preferred embodiment, the phosphodiesterase enzyme is contained within a gel phase secured within or onto the surface of a portion of the apparatus. In a particularly preferred embodiment, the phosphodiesterase enzyme is immobilized in a gel matrix based upon the enzyme's affinity for calmodulin, which is known to those skilled in the art and discussed in greater detail, for example, by Means et al., "Calmodulin" in *Cellular Calcium*, Chapter 9 (J. G. McCormack and D. H. Cobbold eds. 1991). Calmodulin-agarose gel and phosphodiesterase enzyme which may be employed in this invention are commercially available, for example, from Sigma Co. (St. Louis, Mo.).

The cyclic AMP used in this invention is present in an effective concentration, preferably about $5\times10^{-4}$M to $1\times10^{-3}$M. The phosphodiesterase enzyme used in this invention is selected from those phosphodiesterase enzymes inhibited by methylxanthine compounds such as theophylline and caffeine. In a preferred embodiment, commonly isolated and commercially available phosphodiesterase enzymes obtained from cow or pig heart or brain may be used. The phosphodiesterase enzyme is present in an effective concentration, preferably about 1/500 to 1/10 of a unit per assay. A unit is defined herein as the quantity of enzyme which will hydrolyze 1.0 micromole of 3',5'-cyclic AMP to 5'-AMP per minute at a pH of 7.5 and a temperature of 30° C.

In another embodiment of this invention, the methylxanthine-induced inhibition of phosphodiesterase may be coupled to the release of either inorganic phosphorous or adenosine in a two-step or sequential reaction employing two enzymes (i.e. phosphodiesterase and venom) as follows:

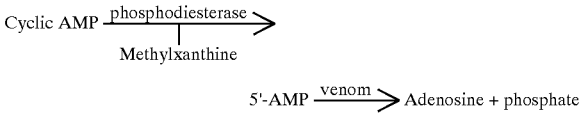

For example, at page 208 of Means et al. in *Cellular Calcium*, the release of inorganic phosphorus from the venom-catalyzed hydrolysis of adenosine monophosphate is described. If phosphodiesterase is inhibited by the presence of methylxanthine, then adenosine and phosphate release will also be inhibited. Accordingly, a colorimetric measurement of inorganic phosphorus release may be used to determine the extent of cyclic AMP hydrolyzation as an alternative to the measurement of hydrogen ion release (i.e. pH shift). In another preferred embodiment, the apparatus comprises calorimetric measurement means which are integral to the apparatus for measuring adenosine, as for example by the adenylate reaction releasing ammonia disclosed in Stryer & Lubert, *Biochemistry* at p. 544.

The portable apparatus of this invention should be made from a material suitable to prevent the melting or degradation of the apparatus if it is immersed or exposed to a hot liquid beverage such as coffee or tea. Accordingly, the apparatus is preferably made from wood or a plastic material having a melting point higher than the temperature of the solution to be tested. For example, if the solution to be tested is hot coffee or tea, the apparatus will have a melting point higher than these hot beverages: i.e. higher than about 212 degrees F.

In one particularly preferred embodiment, the apparatus additionally comprises covering means for protecting the apparatus. In this manner, the apparatus may be carried in a pocket, handbag, briefcase and the like while the detecting means are protected from exposure to moisture, vibration, or possible other sources of damage or contamination prior to use. The covering means may be attached to the apparatus by means of conventional means well known to those skilled in the art. For example, the apparatus may additionally comprise a foil sealed packet which enclosed the apparatus prior to use. An eye dropper or capillary tube for introducing the test sample to the apparatus may also be included and may also be enclosed by such covering means.

In a particularly preferred embodiment, the apparatus is designed to be a completely disposable, single use apparatus. For example, in one embodiment the disposable, single use apparatus may be packaged as multiple test "strips" within a single package.

The method of this invention for determining the presence of methylxanthine chemical species in solution comprises contacting a test portion of the solution of interest (e.g. a beverage such as coffee or tea) with at least one phosphodiesterase enzyme and cyclic AMP, and thereafter contacting the test portion with means for indicating the inhibition of the degradation of cyclic AMP by phosphodiesterase due to the presence of at least one methylxanthine compound.

In one embodiment, the test portion is first contacted with at least one phosphodiesterase enzyme, and immediately thereafter contacted with cyclic AMP. In another embodiment, a first test portion is contacted with at least one phosphodiesterase enzyme. A second test portion is contacted with cyclic AMP, which is dissolved in the second test portion and then chromatographically conveyed to at least one enzyme, the enzyme being at least partially hydrated due to its "wetting" via prior contact with the first test portion. The first and second test portions may then be allowed to admix.

After contacting with cyclic AMP, the test portion is contacted with means for indicating the inhibition of the degradation of cyclic AMP by phosphodiesterase due to the presence of at least one methylxanthine compound. In one preferred embodiment, means responsive to a change in concentration of hydrogen ions in the test portion is employed. More particularly, the change in concentration of hydrogen ions may be calorimetric means such as a calorimetric pH indicator.

In another embodiment, the concentration of hydrogen ions may be detected by a pH-sensitive electrode assembly embedded in or affixed to the surface of the apparatus. The apparatus may then be plugged into a portable battery-powered pH meter which is capable of registering the concentration of hydrogen ions resulting from application of the test solution to the apparatus. In a preferred embodiment, the electrode assembly is affixed to or embedded in the enzyme-containing portion or phase of the apparatus.

In another embodiment, the method employs the measurement of the release of inorganic phosphorus or adenosine due to the two-step phosphodiesterase and venom-catalyzed hydrolysis of adenosine monophosphate. In this embodiment, means responsive to the release of inorganic phosphorus or adenosine into the test portion may be employed to indicate the degree of inhibition of cyclic AMP degradation by phosphodiesterase due to the presence of at least one methylxanthine compound such as caffeine or theophylline.

In yet another embodiment, the method may employ any other means for indicating the inhibition of the degradation of cyclic AMP by phosphodiesterase due to the presence of at least one methylxanthine compound which employs any variable or measurable change resultant from the phosphodiesterase-catalyzed cyclic AMP degradation reaction. In such manner, the variable or measurable change is used as an "output signal" which is transferred as an "input signal" to means for indicating the inhibition of the degradation of cyclic AMP by phosphodiesterase due to the presence of at least one methylxanthine compound. For example, as previously set forth, measurable phosphates, adenosine or AMP concentration changes may be used as the output signal and the correlative input signal to means for indicating such change in concentration, thereby enabling the user to ascertain the presence or absence of at least one methylxanthine compound.

The invention will become apparent from the following detailed description of various preferred embodiments of the invention together with specific references to the accompanying figures.

FIG. 1 depicts a top exposed view of one preferred embodiment of the apparatus of this invention, which may be termed a "radial" configuration of this invention. In FIG. 1, the apparatus 10 comprises a base portion 11 having a well 12 into which a sample of the beverage to be tested is introduced. Well 14 contains the cyclic AMP and appropriate buffers or salts, as necessary. The phosphodiesterase enzyme immobilized in a gel phase is located in well 16 of the apparatus which is adjacent to well 12. A calorimetric pH indicator is located at portion 18 adjacent to well 16. Application of the test solution to well 12 at least partially "wets" the enzyme phase located in well 16 and also dissolves the cyclic AMP in well 14 and permits it to diffuse into the gel phase in well 16, thereby advantageously admixing with the phosphodiesterase enzyme in well 16. The test solution containing cyclic AMP and some phosphodiesterase diffuses into well 16, thereby contacting the enzyme and cyclic AMP and causing the release of H+ ions. The resultant change in pH of the solution is recorded calorimetrically by the indicator located at portion 18.

Figure 1A:
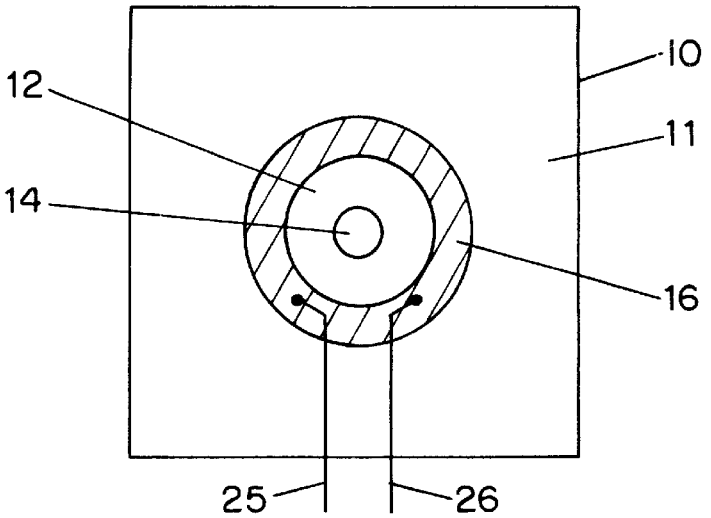
FIG. 1A shows a top exposed view of another embodiment of the "radial" configuration of the apparatus of this invention.

FIG. 1A depicts a top exposed view of another preferred embodiment of the "radial" configuration of the apparatus of this invention. In FIG. 1A, the apparatus 10 comprises a base portion 11 having a well 12 into which a sample of the beverage to be tested is introduced. Well 14 contains the cyclic AMP and appropriate buffers or salts, as necessary. The phosphodiesterase enzyme immobilized in a gel phase is located in well 16 of the apparatus which is adjacent to well 12. Application of the test solution to well 12 at least partially "wets" the enzyme phase in well 16 and also dissolves the cyclic AMP in well 14 and permits it to diffuse into the gel phase in well 16, thereby advantageously admixing with the phosphodiesterase enzyme in well 16. The test solution containing cyclic AMP and some phosphodiesterase diffuses into well 16, thereby contacting the enzyme and cyclic AMP and causing the release of H+ions. Reference electrode 25 and hydrogen ion sensitive electrode 26 are embedded in well 16, as shown. These electrodes are connected, via leads or other means well known to those skilled in the art, to a battery-powered pH meter (not shown) having a digital display. The resultant pH of the solution is determined by the electrical signal conveyed via electrodes 25 and 26 to the pH meter with attendant display. The digital display may be calibrated to read positive or negative with respect to the presence or absence of methylxanthines as opposed to simply providing a numerical display of pH, as is well recognized by those skilled in the art using, for example, conventional software.

Figure 2:
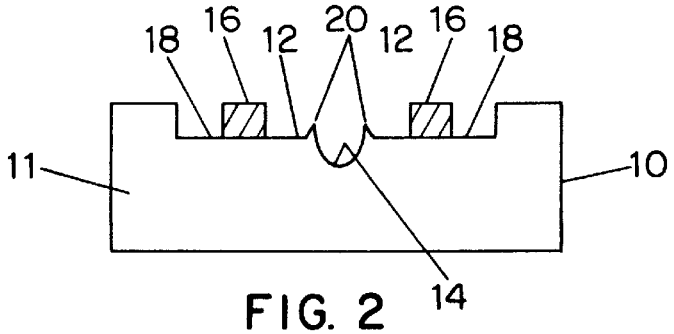
FIG. 2 shows a cross-sectional view of one embodiment of the radial configuration of the apparatus of this invention.

FIG. 2 depicts a cross-sectional side view of another embodiment of the "radial" configuration of the apparatus of this invention, as depicted in FIG. 1 and described above. In FIG. 2, the base portion 11 contains well 12 into which a sample of the beverage to be tested is introduced. Well 14 contains the cyclic AMP and appropriate buffers or salts, as necessary. The phosphodiesterase enzyme immobilized in a gel phase is located in well 16 which is adjacent to well 12. A colorimetric pH indicator is located at portion 18 adjacent to well 16. Well 14 is imbedded or arranged within well 12 in such manner that when a first drop or test portion of the beverage is introduced into well 12, the first drop or test portion will diffuse into the gel phase of well 16, thereby contacting and partially wetting the enzyme phase located in well 16, but ridges 20 prevent the first drop or test portion from entering well 14. A second drop or test portion is then applied to well 14, where it contacts the cyclic AMP contained therein and "overflow" ridges 20 into well 12 and into contact with well 16 containing the enzyme, thereby conveying the cyclic AMP dissolved in the second drop or test portion into contact with the enzyme.

Figure 3:
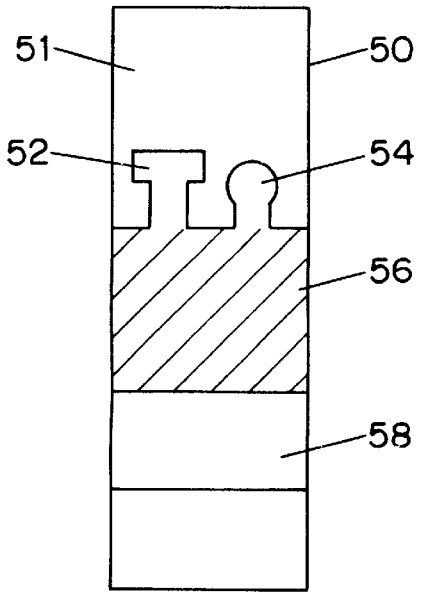
FIG. 3 shows a top view of another embodiment of the apparatus of this invention, termed a "linear" configuration.

FIG. 3 depicts a top view of another embodiment of the apparatus of this invention, which may be termed a "linear" configuration of this invention. In FIG. 3, the apparatus 50 is a plastic film which comprises a base portion 51 having well 54 into which a sample of the beverage to be tested is introduced. Well 54 additionally comprises buffers or salts sufficient to bring the test solution to a pH in the range of 7–8. Well 52 contains dehydrated cyclic AMP together with sufficient salts or buffers so that the cyclic AMP is present in a concentration range of about $5\times10^{-4}$M to $1\times10^{-3}$M and a pH range of about 7–8. Portion 56, adjacent to wells 52 and 54, contains phosphodiesterase enzyme immobilized in a gel matrix. Portion 58, adjacent to portion 56, is a colorimetric pH indicator. Application of the test solution to well 54 causes the pH of the test sample to be properly adjusted to a pH range of about 7–8. A first portion of the test solution in well 54 diffuses into portion 56 and admixes with the phosphodiesterase enzyme contained therein, thereby partially "wetting" the enzyme phase located in portion 56. A second portion of the pH-adjusted solution in well 54 admixes with the cyclic AMP contained in well 52 so that the cyclic AMP becomes part of the test solution. Over a short period of time, all of the test solution in well 52 diffuses into portion 56 to enable the cyclic AMP to contact the phosphodiesterase enzyme, thereby enabling the cyclic AMP degradation reaction and generation of H+ ions to occur. The colorimetric indicator 58 records the pH change occurring as a result of the reaction.

Figure 3A:
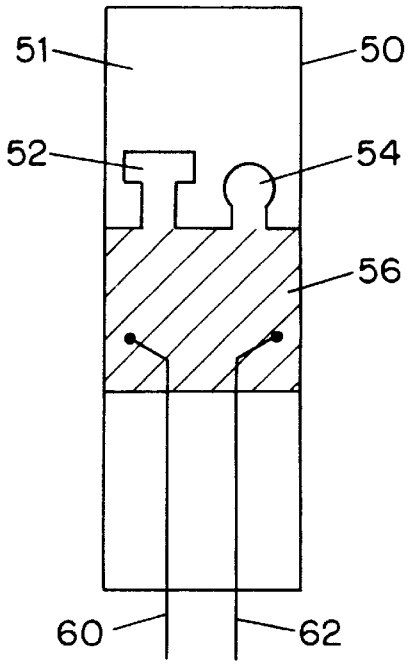
FIG. 3A shows a top view of another embodiment of the "linear" configuration of the apparatus of this invention.

FIG. 3A depicts another preferred embodiment of the "linear" configuration of the apparatus of this invention. In FIG. 3A, the apparatus 50 is a plastic film which comprises a base portion 51 having well 54 into which a sample of the beverage to be tested is introduced. Well 54 additionally comprises buffers or salts sufficient to bring the test solution to a pH in the range of 7–8. Well 52 contains dehydrated cyclic AMP together with sufficient salts or buffers so that the cyclic AMP is present in a concentration range of about $5\times10^{-4}$M to $1\times10^{-3}$M and a pH range of about 7–8. Portion 56, adjacent to wells 52 and 54, contains phosphodiesterase enzyme immobilized in a gel matrix. Application of the test solution to well 54 causes the pH of the test sample to be properly adjusted to a pH range of about 7–8. A first portion of the test solution in well 54 diffuses into portion 56 and admixed with the phosphodiesterase enzyme contained therein, thereby partially "wetting" the enzyme phase located in portion 56. A second portion of the pH-adjusted solution in well 54 admixes with the cyclic AMP contained in well 52 so that the cyclic AMP becomes part of the test solution. Over a short period of time, all of the test solution in well 52 diffuses into portion 56 to enable the cyclic AMP to contact the phosphodiesterase enzyme, thereby enabling the cyclic AMP degradation reaction and generation of H+ ions to occur. Reference electrode 60 and hydrogen ion sensitive electrode 62 are embedded in portion 56, as shown. These electrodes are connected, via leads or other means well known to those skilled in the art, to a batter-powered pH meter (not shown) having a digital display. The resultant change in the pH of the solution is determined by the electrical signal conveyed via electrodes 25 and 26 to the pH meter with attendant display.

EXAMPLE 1

The apparatus of this invention, as described in this specification and depicted in FIG. 1 is used as follows. A test solution of what is purported to be decaffeinated coffee is tested with an apparatus as described in this specification and depicted in FIG. 1. Application of the test solution to well 12 partially "wets" the enzyme phase in well 16 and also dissolves the cyclic AMP in well 14 and permits it to diffuse into the gel phase in well 16, thereby advantageously admixing with the phosphodiesterase enzyme in well 16. The presence of caffeine in the test solution will slow or retard the cyclic AMP degradation reaction and consequently slow the generation of hydrogen ions and resultant downward shift in the pH of the test solution as compared to a non-methylxanthine containing solution. The test solution is then chromatographically conveyed to the calorimetric pH indicator contained within the apparatus, which causes the indicator to yield a distinct color indicative of a pH higher than the pH of about 5–6 exhibited by a non-methylxanthine containing solution. Accordingly, the user concludes that in fact the test solution (i.e. coffee) does contain caffeine, contrary to the initial assertion that the beverage was "decaffeinated."

EXAMPLE 2

The apparatus of this invention, as described in this specification and depicted in FIG. 1 is used as follows. A test solution of what is purported to be a beverage which does not contain theophylline is tested with an apparatus as described in this specification and depicted in FIG. 1. Application of the test solution to well 12 partially "wets" the enzyme phase in well 16 and also dissolves the cyclic AMP in well 14 and permits it to diffuse into the gel phase in well 16, thereby advantageously admixing with the phosphodiesterase enzyme in well 16. The presence of theophylline in the test solution will slow or retard the cyclic AMP degradation reaction and consequently slow the generation of hydrogen ions and resultant downward shift in the pH of the test solution as compared to a non-methylxanthine containing solution. The test solution is then chromatographically conveyed to the calorimetric pH indicator contained within the apparatus, which causes the indicator to yield a distinct color indicative of a pH higher than the pH of about 5–6 exhibited by a non-methylxanthine containing solution. Accordingly, the user concludes that in fact the test solution (i.e. tea) does contain theophylline, contrary to the initial assertion that the beverage did not contain theophylline.

EXAMPLE 3

The apparatus of this invention, as described in this specification and depicted in FIG. 3 is used as follows. A test solution of what is purported to be decaffeinated coffee is tested with an apparatus as described in this specification and depicted in FIG. 3. Application of the test solution to well 54 causes a first portion of the test solution to diffuse into portion 56, thereby partially "wetting" the enzyme phase located in portion 56. A second portion of the test solution in well 54 admixes with the cyclic AMP contained in portion 52 so that the cyclic AMP becomes part of the test solution. Over a short period of time, all the test solution in well 52 diffuses into portion 56. The presence of caffeine in the test solution will slow or retard the cyclic AMP degradation reaction and consequently slow the generation of hydrogen ions and resultant downward shift in the pH of the test solution as compared to a non-methylxanthine containing solution. The test solution is then chromatographically conveyed to the calorimetric pH indicator contained within the apparatus, which, in this example, causes the test paper to yield a distinct color indicative of a pH higher than the pH of about 5–6 exhibited by a non-methylxanthine containing solution. Accordingly, the user concludes that in fact the test solution (i.e. coffee) does contain caffeine, contrary to the initial assertion that the beverage was "decaffeinated."

EXAMPLE 4

The apparatus of this invention, as described in this specification and depicted in FIG. 3 is used as follows. A test solution of what is purported to be decaffeinated coffee is tested with an apparatus as described in this specification and depicted in FIG. 3. Application of the test solution to well 54 causes a first portion of the test solution to diffuse into portion 56, thereby partially "wetting" the enzyme phase located in portion 56. A second portion of the test solution in well 54 admixes with the cyclic AMP contained in portion 52 so that the cyclic AMP becomes part of the test solution. Over a short period of time, all the test solution in well 52 diffuses into portion 56. The presence of caffeine in the test solution will slow or retard the cyclic AMP degradation reaction and consequently slow the generation of hydrogen ions and resultant downward shift in the pH of the test solution as compared to a non-methylxanthine containing solution. The test solution is then chromatographically conveyed to the calorimetric pH indicator contained within the apparatus, which, in this example, causes the test paper to yield a distinct color indicative of a pH of about 5–6 exhibited by a non-methylxanthine containing solution. Accordingly, the user concludes that in fact the test solution (i.e. coffee) does not contain caffeine and is truly decaffeinated as purported.

EXAMPLE 5

The apparatus of this invention, as described in this specification and depicted in FIG. 3 is used as follows. A test solution of what is purported to be a beverage which does not contain theophylline is then tested with an apparatus as described in this specification and depicted in FIG. 3. Application of the test solution to well 54 causes a first portion of the test solution to diffuse into portion 56, thereby partially "wetting" the enzyme phase located in portion 56. A second portion of the test solution in well 54 admixes with the cyclic AMP contained in portion 52 so that the cyclic AMP becomes part of the test solution. Over a short period of time, all the test solution in well 52 diffuses into portion 56. The presence of theophylline in the test solution will slow or retard the cyclic AMP degradation reaction and consequently slow the generation of hydrogen ions and resultant downward shift in the pH of the test solution as compared to a non-methylxanthine containing solution. The test solution is then chromatographically conveyed to the colorimetric pH indicator contained within the apparatus, which, in this example, causes the test paper to yield a distinct color indicative of a pH higher than the pH of about 5–6 exhibited by a non-methylxanthine containing solution. Accordingly, the user concludes that in fact the test solution (i.e. tea) does contain theophylline, contrary to the initial assertion that the beverage did not contain theophylline.

In yet another embodiment of the apparatus of this invention, the apparatus may be an immunochromatographic "stick" which contains antibodies which are specific for methylxanthine chemical species. Immunochromatographic sticks are generally disclosed, for example, in *Clinical Chemistry*, (Kaplan et al. eds.), p. 449 (4th ed.) or Elias-Jones et al., discussed above. In one preferred embodiment, the stick contains antibodies which are specific for theophylline. In another preferred embodiment, the stick contains antibodies which are specific for caffeine. In a particularly preferred embodiment, the stick contains both caffeine-specific antibodies and theophylline-specific antibodies, and thus is capable of detecting either or both species upon contacting with a test solution. In a particularly preferred embodiment, chromatographic paper or film coupled with indicators well known to those skilled in the art may be used to indicate the presence of theophylline and caffeine. For example, in a particularly preferred embodiment, specific antibodies against caffeine and theophylline are immobilized on a small "stick-like" apparatus. Horseradish peroxidase ("HRP")-conjugated theophylline and HRP-conjugated caffeine are prepared and pre-applied to the stick below the level of the antibody. At a calibrated height above the test solution application area of the stick a calorimetric horseradish peroxidase substrate is preapplied (such as 4-chloro-t-naphthol). When test solution containing either theophylline or caffeine is applied to the stick, it competes with the HRP-conjugated caffeine and HRP-conjugated theophylline for antibody binding sites. The higher the concentration of caffeine or theophylline in the test solution, the higher the HRP-conjugated caffeine or HRP-conjugated theophylline, respectively, will migrate up the stick. Should sufficient caffeine or theophylline to constitute a caffeine or theophylline-containing beverage be present in the test solution, the HRP-conjugated caffeine or HRP-conjugated theophylline will migrate into the region of the stick containing the HRP substrate at which point a "positive" colorimetric signal will be produced.

Figure 4:
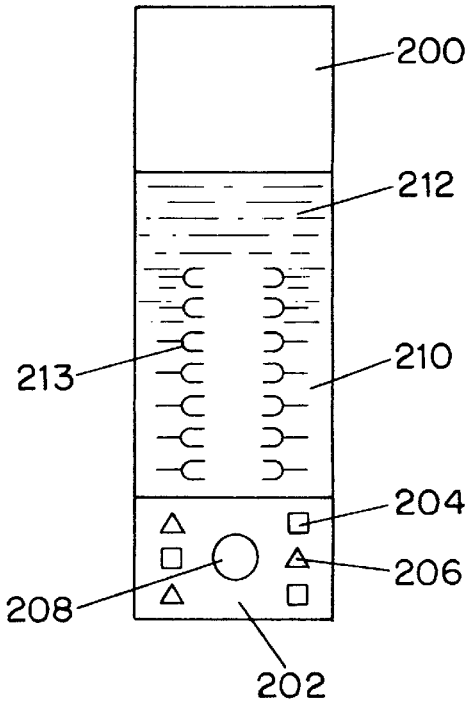
FIG. 4 shows a top view of another embodiment of the apparatus of this invention.

For example, in FIG. 4 the apparatus 200 is a immunochromatographic stick which comprises in portion 202 both HRP-conjugated theophylline (represented by squares 204) and HRP-conjugated caffeine (represented by triangles 206). A well 208 for application for a test solution is also located in portion 202. Portion 210, above and adjacent to portion 202 contains the immobilized antibodies to caffeine and theophylline, as shown and exemplified by antibodies 213. Portion 212, located above and adjacent to portion 210, contains the colorimetric HRP substrate (indicated by shading). Upon contacting of a test solution, containing theophylline or caffeine with well 208, the caffeine or theophylline will compete for antibody binding sites with the HRP-conjugated theophylline 204 and HRP-conjugated caffeine 206, respectively. If sufficient theophylline or caffeine is present in the test solution, the HRP-conjugated theophylline or HRP-conjugated caffeine will migrate into portion 212, causing a positive colorimetric signal to be produced indicating the presence of theophylline or caffeine in the test solution.

Although this invention has been illustrated by reference to specific embodiments, it will be apparent to those skilled in the art that various changes and modifications may be made which clearly fall within the scope of this invention.

We claim:

1. A portable apparatus for detecting the presence of at least one methylxanthine chemical species in a beverage comprising:

(a) a first portion comprising phosphodiesterase enzyme;

(b) a second portion comprising cyclic AMP;

(c) a third portion for receiving a sample of said beverage prior to said sample contacting the phosphodiesterase and the cyclic AMP; and (d) means for indicating inhibition of degradation of the cyclic AMP by the phosphodiesterase due to the presence of the methylxanthine species.

2. The apparatus of claim 1, wherein the apparatus additionally comprises covering means for protecting the apparatus prior to use.

3. The apparatus of claim 1, wherein the means for indicating the inhibition of the degradation of the cyclic AMP by the phosphodiesterase due to the presence of the methylxanthine species is means responsive to a change in concentration of hydrogen ions in the beverage.

4. The apparatus of claim 3, wherein the means responsive to a change in concentration of hydrogen ions in the beverage is a calorimetric pH indicator.

5. The apparatus of claim 3, wherein the means responsive to a change in concentration of hydrogen ions in the beverage is a pH-sensitive electrode assembly.

6. The apparatus of claim 1, wherein the means for indicating the inhibition of the degradation of the cyclic AMP by the phosphodiesterase due to the presence of the methylxanthine species is means for determining the concentration of inorganic phosphate or adenosine released from a two-step reaction wherein in the first step the cyclic AMP forms 5'-AMP in the presence of the phosphodiesterase, and in the second step the 5'-AMP forms said adenosine and inorganic phosphate in the presence of venom.

7. The apparatus of claim 6, wherein the means for indicating the inhibition of the degradation of the cyclic AMP by the phosphodiesterase is a colorimetric means for determining the concentration of the inorganic phosphate.

8. The apparatus of claim 6, wherein the means for indicating the inhibition of the degradation of the cyclic AMP by the phosphodiesterase due to the presence of the methylxanthine species is means for determining the concentration of the adenosine.

9. The apparatus of claim 1, wherein the phosphodiesterase is contained within a gel matrix.

10. A method for determining the presence of at least one methylxanthine chemical species in a beverage comprising:

(a) placing at least one portion of the beverage in a receiving portion of an apparatus, said apparatus additionally comprising a first portion comprising phosphodiesterase enzyme and a second portion comprising cyclic AMP;

(b) contacting said test portion of the beverage with the first and second portions of the apparatus, thereby inhibiting degradation of the cyclic AMP to AMP by the phosphodiesterase due to the presence of any methylxanthine species in the beverage;

(c) contacting the test portion of step (b) with means for indicating the inhibition of the degradation of the cyclic AMP by the phosphodiesterase due to the presence of the methylxanthine species in the beverage; and (d) correlating the inhibition of the degradation of the cyclic AMP by the phosphodiesterase with the presence of the methylxanthine species in the beverage.

11. The method of claim 10, wherein the methylxanthine chemical species is caffeine.

12. The method of claim 10, wherein the methylxanthine chemical species is theophylline.

13. The method of claim 10, wherein the means for indicating the inhibition of the degradation of the cyclic AMP by the phosphodiesterase due to the presence of the methylxanthine species is means responsive to a change in concentration of hydrogen ions in the test portion of the beverage.

14. The method of claim 13, wherein the means responsive to a change in concentration of hydrogen ions in the beverage is a colorimetric pH indicator.

15. The method of claim 10, wherein the means for indicating the inhibition of the degradation of the cyclic AMP by the phosphodiesterase due to the presence of the methylxanthine species is means for determining the concentration of inorganic phosphate or adenosine released from a two-step reaction wherein in the first step the cyclic AMP forms 5'-AMP in the presence of the phosphodiesterase, and in the second step the 5'-AMP forms said adenosine and inorganic phosphate in the presence of venom.

16. The method of claim 15, wherein the concentration of the inorganic phosphate is determined by calorimetric means.

17. The method of claim 15, wherein the means for indicating the inhibition of the degradation of the cyclic AMP by the phosphodiesterase activity due to the presence of the methylxanthine species is means for determining the concentration of said adenosine.

18. The method of claim 10, wherein the test portion is first contacted with the phosphodiesterase, and thereafter contacted with the cyclic AMP.

19. A method for determining the presence of at least one methylxanthine chemical species in a beverage comprising:

(a) providing carrying means having phosphodiesterase enzyme and separately having cyclic AMP such that the phosphodiesterase and the cyclic AMP are not initially in physical contact with each other, said cyclic AMP being degradable by said phosphodiesterase, and wherein said degradation is inhibited in the presence of said at least one methylxanthine species, said carrying means additionally having a receiving portion for receiving a sample of the beverage prior to said sample contacting the phosphodiesterase and the cyclic AMP;

(b) providing detecting means for indicating inhibition of the degradation of the cyclic AMP by the phosphodiesterase in the presence of the methylxanthine species;

(c) physically contacting the sample of said beverage and said carrying means such that said phosphodiesterase and said cyclic AMP are physically contacted; and (d) determining from said detecting means whether said degradation was inhibited, thereby indicating the presence of said at least one methylxanthine species in the beverage.

20. The method of claim 19, wherein the methylxanthine chemical species is caffeine.

21. The method of claim 19, wherein the methylxanthine chemical species is theophylline.

22. The method of claim 19, wherein the detecting means is means responsive to a change in concentration of hydrogen ions in the sample.

23. The method of claim 19, wherein the sample is first contacted with the phosphodiesterase enzyme, and thereafter contacted with the cyclic AMP.

24. A method for determining the presence of caffeine in a beverage comprising:

(a) placing a test portion of the beverage in a receiving portion of an apparatus, said apparatus additionally comprising a first portion comprising phosphodiesterase enzyme and a second portion comprising cyclic AMP;

(b) contacting said test portion of the beverage with the first and second portions of the apparatus, thereby inhibiting degradation of the cyclic AMP to AMP by the phosphodiesterase due to the presence of any caffeine in the beverage;

(c) contacting the test portion of step (b) with means for indicating the inhibition of the degradation of the cyclic AMP by the phosphodiesterase due to the presence of the caffeine in the beverage; and (d) correlating the inhibition of the degradation of the cyclic AMP by the phosphodiesterase with the presence of said caffeine in the beverage.

25. A method for determining the presence of caffeine in a beverage comprising:

(a) providing carrying means having a phosphodiesterase enzyme and separately having cyclic AMP such that the phosphodiesterase and the cyclic AMP are not initially in physical contact with each other, said cyclic AMP being degradable by said phosphodiesterase, and wherein said degradation is inhibited in the presence of any caffeine in the beverage, said carrying means additionally having a receiving portion for receiving a sample of the beverage prior to said sample contacting the phosphodiesterase and the cyclic AMP;

(b) providing detecting means for indicating the inhibition of the degradation of the cyclic AMP by the phosphodiesterase in the presence of said caffeine;

(c) physically contacting said phosphodiesterase, said cyclic AMP, and said detecting means by means of said sample of said beverage; and (d) determining from said detecting means whether said degradation was inhibited, thereby indicating the presence of said caffeine in the beverage.

* * * * *